US007693446B2

(12) United States Patent
Nakano et al.

(10) Patent No.: US 7,693,446 B2
(45) Date of Patent: Apr. 6, 2010

(54) CLEANING APPARATUS AND IMAGE FORMING APPARATUS

(75) Inventors: Hiroshi Nakano, Nagoya (JP); Koichi Kubo, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 101 days.

(21) Appl. No.: 11/960,877

(22) Filed: Dec. 20, 2007

(65) Prior Publication Data

US 2008/0175618 A1 Jul. 24, 2008

(30) Foreign Application Priority Data

Dec. 27, 2006 (JP) ..... 2006-351665

(51) Int. Cl.
*G03G 15/16* (2006.01)

(52) U.S. Cl. ..... 399/101; 399/297; 399/351

(58) Field of Classification Search ..... 399/101, 399/297, 350, 351, 357
See application file for complete search history.

(56) References Cited

U.S. PATENT DOCUMENTS

2005/0069357 A1* 3/2005 Kabata et al. ..... 399/351
2005/0232668 A1* 10/2005 Shida ..... 399/354
2005/0254868 A1* 11/2005 Naruse et al. ..... 399/350

FOREIGN PATENT DOCUMENTS

| | | |
|---|---|---|
| JP | 03-002887 | 1/1991 |
| JP | 03-067292 | 3/1991 |
| JP | 09-185306 | 7/1997 |

* cited by examiner

*Primary Examiner*—David P Porta
*Assistant Examiner*—Benjamin Schmitt
(74) *Attorney, Agent, or Firm*—Banner & Witcoff, Ltd.

(57) ABSTRACT

There is provided a cleaning apparatus capable of preventing counter-bending of a stripper blade in a more reliable manner. The cleaning apparatus removes toner from a circulation mechanism having a circulating surface that circulates in a two-dimensional manner around one pivotal shaft or two or more pivotal shafts parallel to each other in a housing, the toner attaching to the circulating surface. The cleaning apparatus includes a stripper blade, a securing section, and a counter-bending prevention member. The counter-bending prevention member is formed separately from the securing section and disposed on a downstream side of the stripper blade in the circulation direction of the circulating surface. The counter-bending prevention member prevents bending of the one end portion of the stripper blade on the downstream side in the circulation direction of the circulating surface.

7 Claims, 4 Drawing Sheets

CLEANING APPARATUS AND IMAGE FORMING APPARATUS

CROSS-REFERENCE TO RELATED APPLICATION

This application claims the benefit of Japanese Patent Application No. 2006-351665 filed on Dec. 27, 2006, the content of which is incorporated herein by reference.

BACKGROUND OF THE INVENTION

The present invention relates to a cleaning apparatus and an image forming apparatus.

An electrophotographic image formation apparatus includes a transfer unit that transfers toner (developing agent) onto a sheet and a transport unit that transports the sheet to the transfer unit. The transfer unit includes a photosensitive drum on which an electrostatic latent image corresponding to an image to be formed on the sheet is formed, and the transport unit includes a transport roller or a transport belt.

In such an image forming apparatus, the transfer unit supplies toner in correspondence to the electrostatic latent image formed on the photosensitive drum and transfers the toner onto the sheet to form the image on the sheet. In this process, part of the supplied toner attaches to the circulating surfaces of the photosensitive drum and the transport unit and ends up unnecessary toner (waste toner). If printing (image formation) is carried out with the waste toner attached to the circulating surfaces of the photosensitive drum and the transport unit, the waste toner is retransferred onto the sheet or next sheets, so that an unnecessary image that the user does not intend is formed. To address this problem, a cleaning apparatus is typically provided to remove the toner attached to the circulating surfaces of the photosensitive drum and the transport unit.

There is a known cleaning apparatus, such as the one disclosed in JP-A-3-67292 (FIGS. 5 and 6). The cleaning apparatus removes toner from the cylindrical circulating surface of a photosensitive drum that rotates around one pivotal shaft in a housing. The cleaning apparatus includes a stripper blade and a securing section.

The stripper blade has a substantially plate-shape, the width direction of which is parallel to the pivotal shaft and the longitudinal direction of which is perpendicular to the pivotal shaft. One longitudinal end portion of the stripper blade abuts the circulating surface of the photosensitive drum in such a way that the stripper blade is inclined to scoop the toner attached to the circulating surface of the photosensitive drum.

The securing section is secured to the housing at the position downstream of the stripper blade in the circulation direction of the circulating surface of the photosensitive drum, and secures the other longitudinal end portion of the stripper blade through bonding with an adhesive. The securing section integrally includes a counter-bending preventer that extends from the portion where the other end portion of the stripper blade is bonded and secured toward the one end portion of the stripper blade. The counter-bending preventer is not bonded to the stripper blade but disposed along the stripper blade. The one end portion of the stripper blade is thus bent and abuts the circulating surface of the photosensitive drum with the stripper blade inclined thereto.

In the conventional cleaning apparatus having such a configuration, the stripper blade strips and removes waste toner attached to the circulating surface of the photosensitive drum, thus preventing the problem of formation of an unnecessary image that the user does not intend on a sheet.

In the cleaning apparatus, even when the frictional force between the stripper blade and the circulating surface causes deformation of the one end portion of the stripper blade bending toward the downstream side in the circulation direction of the circulating surface (hereinafter referred to as "counter-bending"), the stripper blade abuts the counter-bending preventer and stops there, so that the counter-bending is restricted. The cleaning apparatus can thus prevent the counter-bending of the stripper blade.

Long-term use of such a conventional cleaning apparatus, however, may cause counter-bending of the stripper blade, which may disadvantageously impair the operation of the photosensitive drum, the transport unit and the like. In particular, assuming that the stripper blade has the same positional error, a reduced curvature radius of the circulating surface for a smaller size of the image forming apparatus increases variation of the set angle of the stripper blade with respect to the circulating surface. As a result, it becomes difficult to control the set angle of the stripper blade that abuts the circulating surface within a predetermined range, so that counter-bending of the stripper blade more likely occurs. Accordingly, in the cleaning apparatus, there has been a need to more reliably prevent the counter-bending of the stripper blade.

SUMMARY

The cleaning apparatus of the invention removes toner from a circulation mechanism having a circulating surface that circulates in a two-dimensional manner around one pivotal shaft or two or more pivotal shafts parallel to each other in a housing, the toner attaching to the circulating surface. The cleaning apparatus includes a stripper blade, a securing section, and a counter-bending prevention member. The stripper blade has a substantially plate-shape, the width direction of which is parallel to the pivotal shaft and the longitudinal direction of which is perpendicular to the pivotal shaft. One longitudinal end portion of the stripper blade abuts the circulating surface to strip the toner attached to the circulating surface. The securing section is secured to the housing and secures the other longitudinal end portion of the stripper blade. The counter-bending prevention member is formed separately from the securing section and disposed downstream of the stripper blade in the circulation direction of the circulating surface. The counter-bending prevention member prevents bending of the one end portion of the stripper blade on the downstream side in the circulation direction of the circulating surface.

The circulating mechanism having a circulating surface that circulates in a two-dimensional manner around one pivotal shaft, the toner attaching to the circulating surface, is specifically a photosensitive drum, a cleaning roller that removes the toner attached to a transport belt, a scraper roller that scrapes the toner attached to a cleaning roller or the like. The circulating mechanism having a circulating surface that circulates in a two-dimensional manner around two or more pivotal shafts parallel to each other, the toner attaching to the circulating surface, is specifically a transport belt or the like.

In the cleaning apparatus of the invention having such a configuration, even when counter-bending of the stripper blade is about to occur, the stripper blade abuts the counter-bending prevention member and stops there, so that the counter-bending is restricted.

In the cleaning apparatus, unlike the conventional cleaning apparatus including the securing section and the counter-bending preventer describe above, the securing section is formed separately from the counter-bending prevention member. Therefore, in the cleaning apparatus, after the other end portion of the stripper blade is secured to the securing section, the counter-bending prevention member can be assembled to the securing section and the stripper blade. Thus, in the cleaning apparatus, the counter-bending prevention member does not affect the range across which the securing section secures the stripper blade, so that the range can be managed in a precise manner. As a result, in the cleaning apparatus, the length of the one end portion of the stripper blade protruding from the securing section less likely varies, so that the pressing force of the one end portion of the stripper blade that abuts the circulating surface is made uniform in the width direction and hence can be easily controlled within a predetermined range. This likely prevents removal failure of the toner.

Therefore, the cleaning apparatus of the invention can prevent removal failure of the toner and counter-bending of the stripper blade in a more reliable manner.

BRIEF DESCRIPTION OF THE SEVERAL VIEWS OF THE DRAWINGS

An embodiment in which the invention is embodied will be described below with reference to the drawings.

DETAILED DESCRIPTION OF THE PREFERRED EMBODIMENTS

The invention has been made in view of the above conventional circumstances. An object of the invention is to provide a cleaning apparatus capable of more reliably preventing the counter-bending of the stripper blade.

The inventors have investigated causes of the counter-bending of the stripper blade in the above conventional cleaning apparatus to solve the above problem and found the following causes of the counter-bending.

Figure 4:
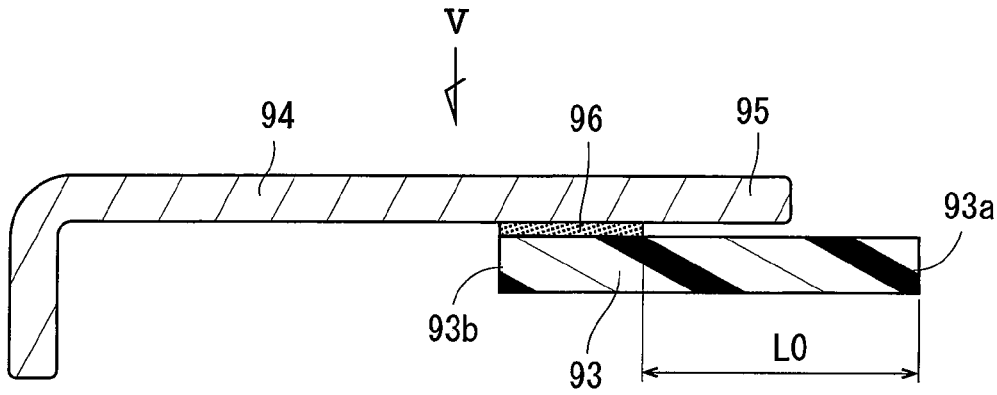
FIG. 4 is an enlarged cross-sectional view that relates to a conventional cleaning apparatus and shows a stripper blade, a securing section, and a counter-bending preventer.
Figure 5:
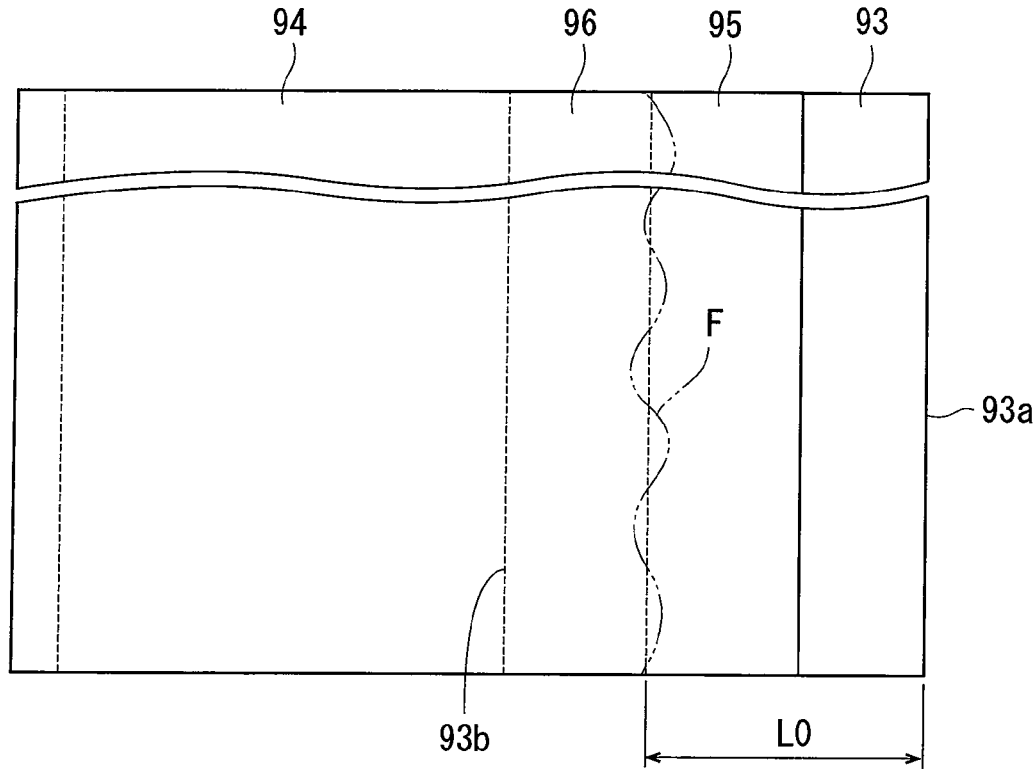
FIG. 5 is a plan view that relates to the conventional cleaning apparatus and shows the stripper blade, the securing section, and the counter-bending preventer when viewed from the direction of the arrow V in FIG. 4.

That is, in the above conventional cleaning apparatus, as shown in FIGS. 4 and 5, the securing section 94 integrally includes the counter-bending preventer 95 described above. The counter-bending preventer 95 is not bonded to the stripper blade 93 but disposed along the stripper blade 93. When the other end portion 93*b* of the stripper blade 93 is bonded and secured to the securing section 94, the melted adhesive 95 flows in the gap between the one end portion 93*a* of the stripper blade 93 and the counter-bending preventer 95 (indicated by the double-dashed line F in FIG. 5), so that the length L0, the length of the one end portion 93*a* of the stripper blade 93 protruding from the securing section 94, likely varies. Variation in the protruding length L0 of the stripper blade 93 causes width-direction variation of the pressing force exerted by the one end portion 93*a* of the stripper blade 93 that abuts the circulating surface. This likely leads to poor removal of the toner, that is, the toner can be removed at high-pressure portions, while the toner passes through at low-pressure portions.

The inventors have intensively studied taking into consideration that it is important to prevent the protruding length of the stripper blade from varying, and have attained the invention.

Embodiment 1

Figure 1:
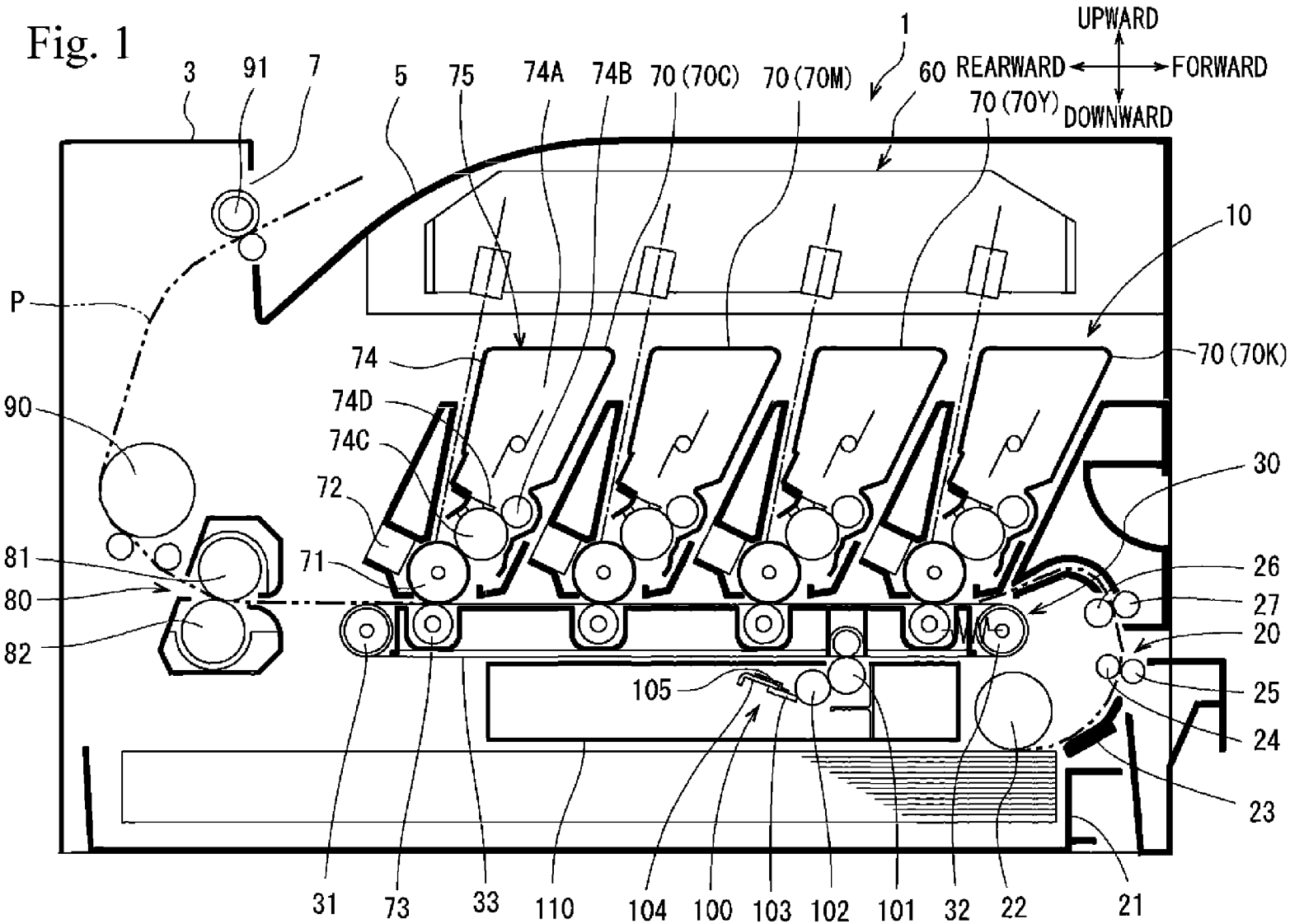
FIG. 1 is a schematic cross-sectional view of a laser printer to which the cleaning apparatus according to the embodiment is applied.

As shown in FIG. 1, the cleaning apparatus 100 of this embodiment is applied to a laser printer 1 as an electrophotographic image forming apparatus. The specific configuration of the laser printer 1 will first be described, and the specific configuration of the cleaning apparatus 100 will then be described.

1. Exterior Configuration of Laser Printer

The laser printer 1 is installed in such a way that the upper part of the drawing sheet of FIG. 1 is oriented upward in the direction of gravity and the right part of the drawing sheet of FIG. 1 is oriented forward. The laser printer 1 is used in such a way that the right part of the drawing sheet of FIG. 1 faces a user. The laser printer 1 includes a transfer unit 10 and a transport unit in a substantially box-like (rectangular parallelepiped) housing 3. An ejection tray 5 is provided on the upper side of the housing 3 to place a printed sheet (a sheet of paper and an OHP sheet, for example) ejected from the housing 3.

In this embodiment, a frame member made of metal, resin or the like is provided in the housing 3, and development toner cartridges 70, a fixing unit 80 and the like, which will be described later, are removably assembled to the frame member (not shown) provided in the housing 3.

2. Summary of Internal Configuration of Laser Printer

The transfer unit 10 transfers toner onto a sheet to form an image. The transport unit includes a feeder 20 that feeds a sheet to the transfer unit 10, and a transport mechanism 30 that transports the sheet to four development toner cartridges 70K, 70Y, 70M and 70C that form the transfer unit 10.

An intermediate transport roller 90 and an ejection shoot (not shown) turns the transport direction of the sheet, on which an image has been formed in the transfer unit 10, upward approximately by 180 degrees, and then an ejection roller 91 ejects the sheet from an ejection section 7 onto the ejection tray 5.

2.1. Feeder

The feeder 20 includes a sheet feed tray 21 housed in the lowest portion of the housing 3, a sheet feed roller 22 provided in the upper front portion of the sheet feed tray 21 and feeding (transporting) sheets placed in the sheet feed tray 21 to the transfer unit 10, and a separation pad 23 that applies predetermined transport resistance to the sheets fed by the sheet feed roller 22 to separate them one-by-one.

The sheet placed in the sheet feed tray 21 is turned over in the front portion of the housing 3 and transported to the transfer unit 10 disposed at the substantial center in the housing 3. To this end, a transport roller 24, which applies a transport force to the sheet so that the sheet is bent into a substantially U-shape and transported to the transfer unit 10, is disposed in the front portion where the transport path (indicated by the double-dashed line P) of the sheet from the sheet feed tray 21 to the transfer unit 10 turns in a substantially U-shaped manner.

A pressure roller 25 that presses the sheet against the transport roller 24 is disposed on the opposite side of the sheet to the transport roller 24. An elastic member, such as a coil spring (not shown), presses the pressure roller 25 toward the transport roller 24.

A register roller 26 and a register rolling rod 27 disposed opposite to the register roller 26 are provided downstream of the transport roller 24 in the sheet transport direction. The register roller 26 and the register rolling rod 27 come into contact with the front end of the sheet transported by the transport roller 24 to correct diagonal movement of the sheet and then transport the sheet toward the transfer unit 10. An elastic member, such as a coil spring (not shown), presses the register rolling rod 27 toward the register roller 26.

2.2. Transport Mechanism

The transport mechanism 30 includes a drive roller 31 that rotates in synchronization with the operation of the transfer unit 10, a driven roller 32 rotatably disposed at a position apart from the drive roller 31, and a transport belt 33 engaged with the drive roller 31 and the driven roller 32.

When the transport belt 33 rotates with the sheet placed thereon, the sheet transported from the sheet feed tray 21 is sequentially transported to the four development toner cartridges 70K, 70Y, 70M and 70C.

The cleaning apparatus 100, which will be described later in detail, is provided under the transport mechanism 30 to remove the toner attached to the surface of the transport belt 33.

2.3. Transfer Unit

The transfer unit 10 includes, as shown in FIG. 1, a scanner 60, the development toner cartridges 70, and the fixing unit 80.

The transfer unit 10 according to this embodiment is of a so-called direct tandem type capable of color printing. In this embodiment, the four development toner cartridges 70K, 70Y, 70M and 70C corresponding to toners (development agents) of four colors, black, yellow, magenta, and cyan, are disposed in tandem along the sheet transport direction in this order from the upstream side.

The four development toner cartridges 70K, 70Y, 70M and 70C are the same except that the colors of the respective toners are different from each other. The four development toner cartridges 70K, 70Y, 70M and 70C are collectively referred to as the development toner cartridges 70.

2.3.1. Scanner

The scanner 60 is provided in the upper part of the housing 3 and forms an electrostatic latent image on the surface of a photosensitive drum 71 provided in each of the four development toner cartridges 70K, 70Y, 70M and 70C. Specifically, the scanner 60 includes a laser light source, a polygonal mirror, an fθ lens, and reflective mirrors.

The laser beam emitted from the laser light source based on image data is deflected off the polygonal mirror, and passes through the fθ lens. The light path of the laser beam is then folded back by one of the reflective mirrors and further bent downward by another reflective mirror. The laser beam is thus applied to the surface of the photosensitive drum 71 to form an electrostatic latent image.

2.3.2. Development Toner Cartridge

Since the four development toner cartridges 70K, 70Y, 70M and 70C are the same except that the colors of the respective toners are different from each other, the structure of the development toner cartridge 70C will be described by way of example.

The development toner cartridge 70C is removably disposed in the housing 3 under the scanner 60. The development toner cartridge 70C includes a casing 75 that houses the cylindrical photosensitive drum 71, a charger 72, and a toner container 74.

A transfer roller 73 is rotatably supported by the frame member on the opposite side of the transport belt 33 to the photosensitive drum 71. The outermost layer of the photosensitive drum 71 is formed of a positively chargeable photosensitive layer made of polycarbonate or the like to carry an image to be transferred onto a sheet.

The charger 72 charges the surface of the photosensitive drum 71 and is disposed behind the photosensitive drum 71 in a diagonally upward direction and apart from the photosensitive drum 71 by a predetermined distance in such a way that the charger 72 faces the photosensitive drum 71 but does not come into contact therewith.

The charger 72 employed in this embodiment is a scorotron charger that positively charges the surface of the photosensitive drum 71 in a substantially uniform manner through corona discharge from a charging wire made of tungsten or the like.

The transfer roller 73 is disposed in such a way that it faces the photosensitive drum 71 and rotates in synchronization with the rotation of the transport belt 33. When a sheet passes through a region close to the photosensitive drum 71, the transfer roller 73 applies electric charge with polarity (negative electric charge in this embodiment) opposite to that of the electric charge on the photosensitive drum 71 onto the sheet from the opposite side of the printed surface, so that the toner attached to the surface of the photosensitive drum 71 is transferred onto the printed surface of the sheet.

The toner container 74 includes a toner container compartment 74A that contains toner, a toner supply roller 74B that supplies the toner to the photosensitive drum 71, and a development roller 74C. The toner contained in the toner container compartment 74A is supplied on the development roller 74C side by the rotation of the toner supply roller 74B. The toner supplied on the development roller 74C side is carried on the surface of the development roller 74C and the thickness of the carried toner is adjusted by a layer thickness regulation blade 74D to be a predetermined fixed (uniform) thickness. The toner is then supplied onto the surface of the photosensitive drum 71 that has been exposed to light from the scanner 60.

2.3.3. Fixing Unit

The fixing unit 80 is disposed downstream of the photosensitive drum 71 in the sheet transport direction, and heats and melts the toner transferred onto the sheet so that the toner is fixed. The fixing unit 80 is removably assembled to the frame member described above.

Specifically, the fixing unit 80 includes a heating roller 81 that is disposed on the printed surface side of the sheet and imparts a transport force to the sheet while heating it, and a pressure roller 82 that is disposed on the opposite side of the sheet to the heating roller 81 and presses the sheet against the heating roller 81.

The heating roller 81 rotates in synchronization with the development roller 74C, the transport belt 33 and the like. On the other hand, the pressure roller 82 receives the rotational force from the heating roller 81 via the sheet in contact with the heating roller 81 and rotates accordingly.

2.3.4. Summary of Image Forming Operation

In the transfer unit 10, an image is formed on a sheet in the following manner. That is, when the photosensitive drum 71 rotates, the surface thereof is positively charged by the charger 72 in a uniform manner, and then exposed to the laser beam scanned at a high-speed by the scanner 60. In this way, an electrostatic latent image corresponding to the image to be formed on the sheet is formed on the surface of the photosensitive drum 71.

Then, when the development roller 74C rotates so that the positively charged toner carried on the development roller 74C faces the photosensitive drum 71 and comes into contact therewith, the toner is supplied to the electrostatic latent image formed on the surface of the photosensitive drum 71, that is, the portion of the surface of the positively and uniformly charged photosensitive drum 71 that is exposed to the laser beam and hence has a reduced potential. In this way, the electrostatic latent image on the photosensitive drum 71 becomes visible, and a toner image generated by reversal development is carried on the surface of the photosensitive drum 71.

Then, the toner image carried on the surface of the photosensitive drum 71 is transferred onto the sheet by a transfer bias applied to the transfer roller 73. The sheet onto which the toner image is transferred is transported to the fixing unit 80, where the sheet is heated and the toner transferred as the toner image is fixed on the sheet. The image formation is thus completed.

When the laser printer 1 forms an image in the manner described above, part of the supplied toner attaches to the transport belt 33 and becomes unnecessary toner (waste toner). If the printing (image formation) is carried out with the waste toner attached to the transport belt 33, the waste toner is retransferred onto the sheet or next sheets, so that an unnecessary image that the user does not intend is disadvantageously formed. To address this problem, the laser printer 1 includes the cleaning apparatus 100 that removes the toner attached to the transport belt 33. The detail of the cleaning apparatus 100 will be described below.

2.4. Detail of Cleaning Apparatus

Figure 2:
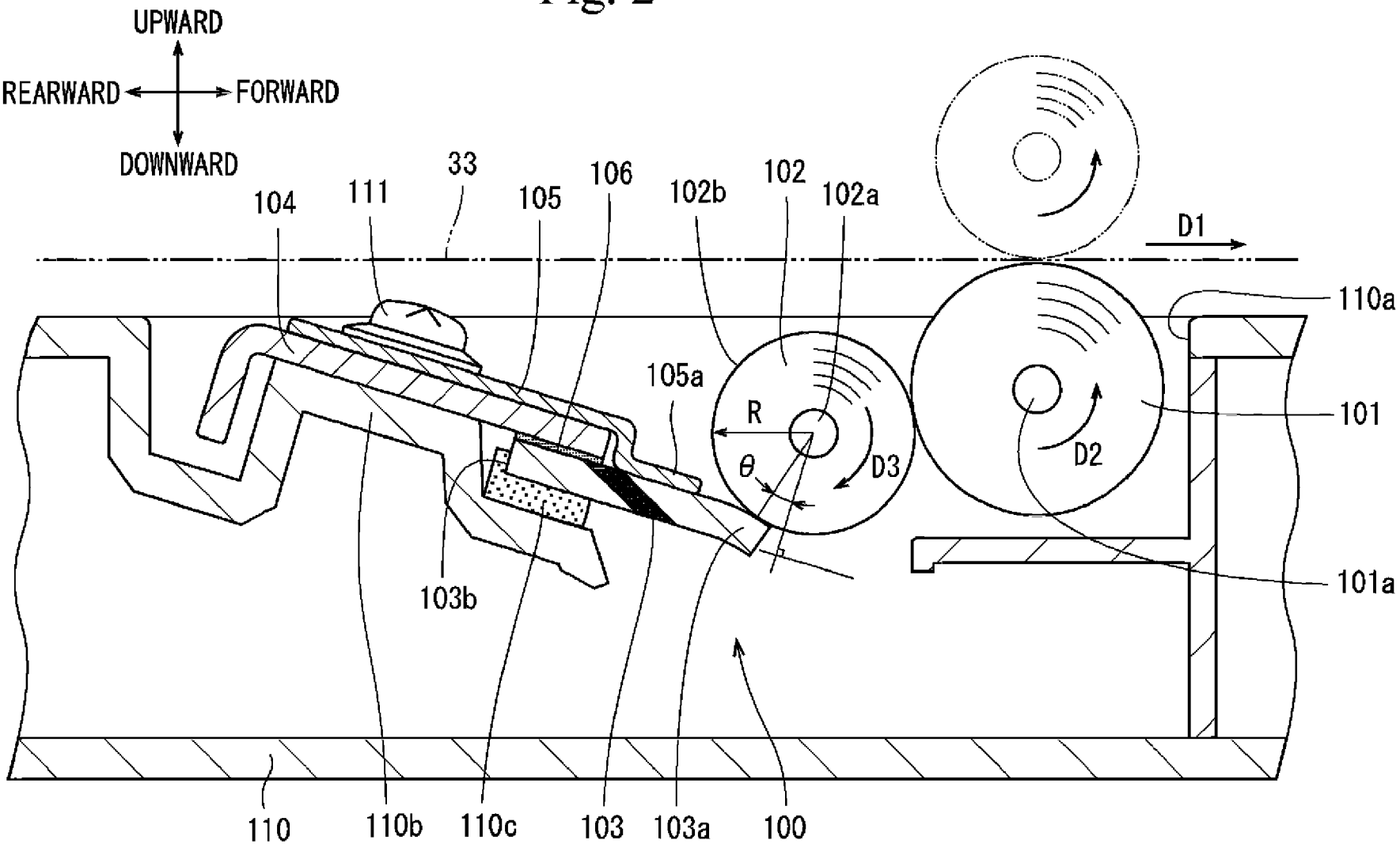
FIG. 2 is an enlarged view of the cleaning apparatus according to the embodiment.

As shown in FIG. 2, the cleaning apparatus 100 includes a cleaning apparatus housing 110, a cleaning roller 101, a scraper roller 102, a stripper blade 103, a securing section 104, and a counter-bending prevention member 105.

The cleaning apparatus housing 110 has a substantially box-like (rectangular parallelepiped) shape, removably provided on the frame member described above, and disposed under the transport belt 33.

An opening 110*a* having substantially the same width as that of the transport belt 33 is formed in the upper surface of the cleaning apparatus housing 110. The cleaning roller 101 and the scraper roller 102 are disposed in the front portion of the opening 110*a*.

The cleaning roller 101 is a solid cylinder having a resin sponge layer formed on its outer surface and rotatably journaled by a pivotal shaft 101*a* parallel to the drive roller 31 and the driven roller 32. The outer diameter of the cleaning roller 101 is small for reducing the size of the laser printer 1 and ranges from 20 to 30 mm in this embodiment.

The cleaning roller 101 is configured to rotate in the rotational direction D2, which is the direction opposite to the circulation direction D1 of the transport belt 33, and come into contact with the underside of the transport belt 33. The cleaning roller 101 can scrub the toner attached to the surface of the transport belt 33 and attach the scrubbed toner to the surface of the cleaning roller 101, so as to remove the toner from the transport belt 33.

The scraper roller 102 is positioned behind the cleaning roller 101. The scraper roller 102 is a metallic solid cylinder having a cylindrical circulating surface 102*b* and rotatably journaled by a pivotal shaft 102*a* parallel to the drive roller 31, the driven roller 32, and the pivotal shaft 101*a*. The scraper roller 102 corresponds to a circulation mechanism having the circulating surface 102*b* that circulates around the one pivotal shaft 102*a* in a two-dimensional manner in the housing 3, and the toner is attached to the circulating surface 102*b* of the circulation mechanism.

The outer diameter of the scraper roller 102 is reduced to 20 mm or smaller for reducing the size of the laser printer 1. In other words, the curvature radius R of the cylindrical circulating surface 102*b* of the scraper roller 102 is within the range expressed by the following equation:

$$R \leqq 10 \text{ mm} \qquad \text{(Equation 1)}$$

According to the evaluation derived from the test that the inventors have conducted, the range of R>10 mm is a region in which counter-bending of the stripper blade 103 (which will be described later) that abuts the scraper roller 102 does not likely occur. The range of 4 mm≦R≦10 mm is an unstable region in which the counter-bending of the stripper blade 103 likely occurs. The range of R<4 mm is a less practical region in which counter-bending of the stripper blade 103 frequently occurs. In this embodiment, the curvature radius R of the circulating surface 102*b* is approximately 6 mm.

The scraper roller 102 is configured to be in contact with the surface of the cleaning roller 101 and rotate in the rotational direction D3 with electric charge applied to the scraper roller 102, the electric charge having polarity (negative electric charge in this embodiment) opposite to that of the toner. The scraper roller 102 can thus electrically adsorb the toner attached to the surface of the cleaning roller 101 and transfer the toner onto the circulating surface 102*b*.

A securing section support 110*b* is integrally formed in the rear portion of the opening 110*a* in such a way that the securing section support 110*b* protrudes forward and diagonally downward. The securing section 104, to which the stripper blade 103 is bonded, is secured to the upper surface of the securing section support 110*b* with a securing screw 111. The counter-bending prevention member 105 overlies the upper surface of the securing section 104, and they are fastened together to the securing section support 110*b* with the securing screw 111. A sponge sheet 110*c* is disposed between the front end portion of the securing section support 110*b* and the rear end portion 103*b* of the stripper blade 103 to seal the gap therebetween. This prevents the waste toner removed from the circulating surface 102*b* by the stripper blade 103 from leaking to the outside.

Figure 3:
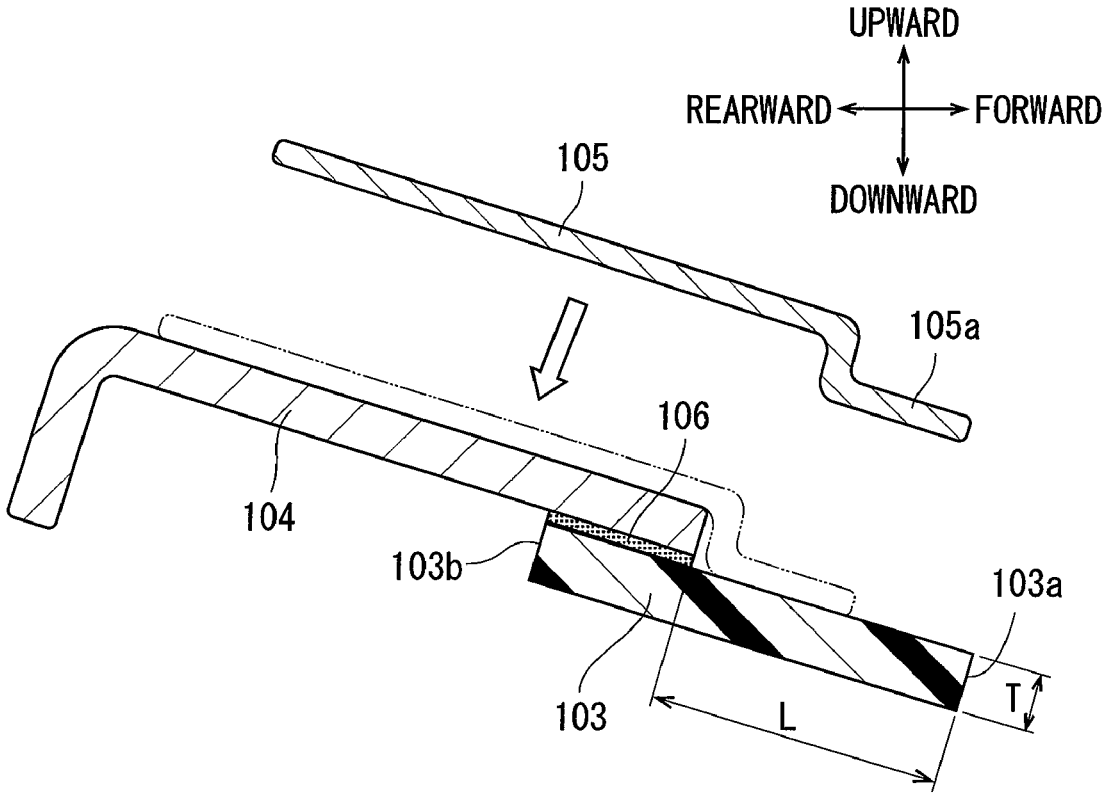
FIG. 3 is an enlarged cross-sectional view that relates to the cleaning apparatus according to the embodiment and shows a stripper blade, a securing section, and a counter-bending prevention member.

As shown in FIG. 3, the securing section 104 is a sheet metal having a thickness of approximately 1.6 mm and bent into an L shape in cross section. The securing section 104 secured to the securing section support 110*b* is positioned downstream of the stripper blade 103 in the rotational direction D3 of the circulating surface 102*b*.

The counter-bending prevention member 105 is formed of a sheet metal having a thickness of approximately 0.6 mm, which is thinner than the securing section 104, and the front end portion 105*a* of the counter-bending prevention member 105 is bent into a crank shape in cross section. By placing the counter-bending prevention member 105 on the upper surface of the securing section 104 and fastening them together, the front end portion 105*a* of the counter-bending prevention member 105 protrudes forward from the front end of the securing section 104, and is positioned downstream of the stripper blade 103 in the rotational direction D3 of the circulating surface 102*b*.

By applying electric charge having the same voltage as that of the scraper roller 102 to the counter-bending prevention member 105, which is formed of a sheet metal, no spark will be generated between the counter-bending prevention member 105 and the scraper roller 102.

The stripper blade 103 is shaped into a plate, the width direction of which is parallel to the pivotal shaft 102*a* (the direction oriented from the side closer to the reader of FIG. 3 toward the side away from the reader) and the longitudinal direction of which is perpendicular to the pivotal shaft 102*a*. The stripper blade 103 is a cut soft urethane sheet, the thickness T of which is approximately 2 mm in this embodiment.

The longitudinal rear end portion 103*b* of the stripper blade 103 is bonded and secured to the front end portion of the securing section 104 by a hot melt adhesive. The stripper blade 103 is bonded and secured to the securing section 104 before the counter-bending prevention member 105 is assembled thereto, as shown in FIG. 3. Thus, an adhesive 106, when heated and melted, less likely flows out of the region where the securing section 104 overlaps with the stripper blade 103, allowing precise management of the length L of the front end portion 103*a* of the stripper blade 103 protruding from the securing section. The protruding length L is approximately 8 mm in this embodiment.

The front end portion 103*a* of the stripper blade 103 having such a configuration abuts the circulating surface 102*b* at a set angle θ (θ is approximately 18 degrees in this embodiment) in such a way that the toner attached to the circulating surface 102*b* is scooped as shown in FIG. 2. According to the evaluation derived from the test that the inventors have conducted, the range of θ>30 degrees is a less practical region in which counter-bending of the stripper blade 103 frequently occurs. The range of θ<10 degrees is a less practical region in which the toner likely passes through the stripper blade 103. The range of 10 degrees≦θ≦30 degrees is a practically stable region.

Furthermore, according to the evaluation derived from the test that the inventors have conducted, it is found that when the curvature radius R of the circulating surface 102*b* is within the range of R≦10 (Equation 1), and the protruding length L and the thickness T of the stripper blade 103 satisfy the following equations, counter-bending of the stripper blade 103 less likely occurs and the toner can be effectively removed.

$$1 \leqq T \times R/L \leqq 4 \quad \text{(Equation 2)}$$

$$3 \leqq L/T \leqq 8 \quad \text{(Equation 3)}$$

More specifically, L/T in Equation 3 is a parameter indicative of bending resistance of the stripper blade 103. When L/T is within the range expressed by Equation 3, the front end portion 103*a* of the stripper blade 103 is moderately bent and abuts the circulating surface 102*b*, allowing effective removal of the toner. When the range expressed by Equation 2 is satisfied, the size of the stripper blade 103, represented by the protruding length L and the thickness T, and the curvature radius R of the circulating surface 102*b* have a similarity relation of a fixed range, so that counter-bending less likely occurs. In this embodiment, since T×R/L=2×6/8=1.5, L/T=8/2=4, which satisfy Equations 2 and 3, the advantageous effect of the invention significantly benefits the embodiment.

In the cleaning apparatus 100 having such a configuration, the toner attached to the transport belt 33 is transferred from the transport belt 33 to the cleaning roller 101, and further transferred from the cleaning roller 101 to the scraper roller 102. Then, the stripper blade 103 strips the waste toner attached to the circulating surface 102*b* of the scraper roller 102 and scrapes the waste toner off in the space of the cleaning apparatus housing 110, thus eliminating the problem of formation of an unnecessary image that the user does not intend on the sheet.

Furthermore, in the cleaning apparatus 100, even when the frictional force between the stripper blade 103 and the circulating surface 102*b* causes deformation of the stripper blade 103 in such a way that the front end portion 103*a* thereof is bent on the downstream side in the rotational direction D3 of the circulating surface 102*b*, the stripper blade 103 abuts the counter-bending prevention member 105 and stops there, so that the counter-bending is restricted. The cleaning apparatus 100 is thus configured to prevent counter-bending of the stripper blade 103.

In the cleaning apparatus 100 of this embodiment, since the securing section 104 is formed separately from the counter-bending prevention member 105, the rear end portion 103*b* of the stripper blade 103 can be secured to the securing section 104, and then the counter-bending prevention member 105 can be assembled to the securing section 104 and the stripper blade 103. Thus, in the cleaning apparatus 100, the counter-bending prevention member 105 does not affect the range across which the securing section 104 secures the stripper blade 103, so that the range can be managed in a precise manner. As a result, in the cleaning apparatus 100, the protruding length L of the stripper blade 103 less likely varies, so that the pressing force of the front end portion 103*a* of the stripper blade 103 that abuts the circulating surface 102*b* is made uniform in the width direction and hence easily controlled within a predetermined range.

Therefore, the cleaning apparatus 100 of this embodiment is configured to prevent counter-bending of the stripper blade 103 in a more reliable manner.

In the cleaning apparatus 100, the counter-bending prevention member 105 is formed of a sheet metal thinner than the securing section 104. Thus, in the cleaning apparatus 100, the counter-bending prevention member 105 less likely comes into contact with the circulating surface 102*b* and hence can be more easily close to the circulating surface 102*b*. The cleaning apparatus 100 is thus configured to prevent counter-bending of the stripper blade 103 in an even more reliable manner. Furthermore, the inexpensive sheet metal allows manufacturing cost reduction.

Moreover, in the cleaning apparatus 100, after the rear end portion 103*b* of the stripper blade 103 is secured to the securing section 104 with a hot melt adhesive, the counter-bending prevention member 105 can be assembled to the securing section 104 and the stripper blade 103. Thus, unlike the conventional cleaning apparatus, there is no problem of possible variation in the protruding length of the stripper blade due to the melted adhesive that flows out of the securing section into the gap between the one end portion of the stripper blade and the counter-bending preventer. Thus, in the cleaning apparatus 100, the hot-melt adhesive does not affect the range across which the securing section 104 secures the stripper blade 103, so that the range can be managed in a precise manner, allowing the advantageous effect of the invention to be provided in an even more reliable manner.

Since the cleaning apparatus 100 uses a hot melt adhesive to strongly secure the rear end portion 103*b* of the stripper blade 103 to the securing section 104 only by heating, it is possible to improve not only the productivity but also the durability, because the stripper blade 103 is less likely disengaged from the securing section 104.

Furthermore, according to the advantageous effect of the cleaning apparatus 100 in the laser printer 1 of this embodiment, the toner is removed from the transport belt 33 in a reliable manner, and problems, for example, due to counter-bending of the stripper blade 103 less likely occur.

Although the invention has been described with reference to the embodiment described above, the invention is not limited thereto. Changes can of course be made to the above embodiment as appropriate to the extent that they do not depart from the spirit of the invention.

For example, the counter-bending prevention member 105 formed of a sheet metal may be replaced with a counter-bending prevention member made of a highly insulating material, such as an engineering plastic. In this case, no electric charge needs to be applied to the counter-bending prevention member to prevent generation of spark between the counter-bending prevention member and the scraper roller 102, allowing the apparatus to be simplified.

The stripper blade 103, the securing section 104, and the counter-bending prevention member 105 of this embodiment may be used to directly remove the toner attached to the transport belt 33.

Alternatively, the stripper blade 103, the securing section 104, and the counter-bending prevention member 105 of this embodiment may be used to directly remove the toner attached to the photosensitive drum 71.

Although the counter-bending prevention member may be made of any material as long as the material provides the advantageous effect of the invention, the material desirably has high rigidity. Examples of the material may be metals, engineering plastics, and fiber reinforced plastics.

The securing section may be disposed downstream of the stripper blade in the circulation direction of the circulating surface, or may be disposed upstream of the stripper blade in the circulation direction.

The securing section may secure the other end portion of the stripper blade in any way as long as the range across which the securing section secures the stripper blade is controllable in a precise manner. For example, the other end portion of the stripper blade may be inserted in a recess formed in the securing section, and the recess may be externally caulked. Alternatively, a securing section having a recess formed therein is placed in an injection die to perform insert-forming of the stripper blade in such a way that the other end portion of the stripper blade is buried in the recess. Still alternatively, the other end portion of the stripper blade may be bonded and secured to the securing section with a strong double-sided adhesive tape.

The hot-melt adhesive can be any one of general ones, preferably the one with high bonding strength, excellent heat-resistance and durability, for example, a urethane-based adhesive.

The invention is applicable to any electrophotographic image forming apparatus.

The invention claimed is:

1. A cleaning apparatus for removing toner from a circulation mechanism having a circulating surface that circulates in a two-dimensional manner around one pivotal shaft or two or more pivotal shafts parallel to each other in a housing, the toner attaching to the circulating surface, the cleaning apparatus comprising:

a stripper blade having a substantially plate-shape, the width direction of which is parallel to the pivotal shaft and the longitudinal direction of which is perpendicular to the pivotal shaft, one longitudinal end portion of the stripper blade abutting the circulating surface to strip the toner attached to the circulating surface;

a securing section that is secured to the housing and secures the other longitudinal end portion of the stripper blade; and a counter-bending prevention member that is formed separately from the securing section and disposed on the stripper blade in the circulation direction of the circulating surface, the counter-bending prevention member on a side of the stripper blade facing the circulating surface, and the counter-bending prevention member configured to prevent bending of the one end portion of the stripper blade on the downstream side in the circulation direction of the circulating surface.

2. The cleaning apparatus according to claim 1, wherein the counter-bending prevention member is formed of a sheet metal thinner than the securing section.

3. The cleaning apparatus according to claim 1, wherein the securing section secures the other end portion of the stripper blade with an adhesive.

4. The cleaning apparatus according to claim 3, wherein the adhesive is a hot melt adhesive.

5. The cleaning apparatus according to claim 1, wherein the following three equations are satisfied:

$$R \leqq 10 \text{ mm}: \quad \text{Equation 1}$$

$$1 \leqq T \times R/L \leqq 4: \quad \text{Equation 2}$$

$$3 \leqq L/T \leqq 8: \quad \text{Equation 3}$$

where R is the curvature radius of the quadratic curved surface that the one end portion of the stripper blade abuts on the circulating surface, L is the length of the one end portion of the stripper blade protruding from the securing section, and T is the thickness of the stripper blade.

6. An electrophotographic image forming apparatus that forms an image on a sheet, the electrophotographic image forming apparatus comprising:

a transfer unit that transfers toner onto the sheet;

a transport belt that transports the sheet to the transfer unit; and a cleaning apparatus that directly removes the toner attached to the transport belt or removes the toner through one or more rollers, wherein the cleaning apparatus removes the toner from a circulation mechanism having a circulating surface that circulates in a two-dimensional manner around one pivotal shaft or two or more pivotal shafts parallel to each other in a housing, the toner attaching to the circulating surface, the cleaning apparatus including a stripper blade having a substantially plate-shape, the width direction of which is parallel to the pivotal shaft and the longitudinal direction of which is perpendicular to the pivotal shaft, one longitudinal end portion of the stripper blade abutting the circulating surface to strip the toner attached to the circulating surface, a securing section that is secured to the housing and secures the other longitudinal end portion of the stripper blade, and a counter-bending prevention member that is formed separately from the securing section and disposed on the stripper blade in the circulation direction of the circulating surface, the counter-bending prevention member on a side of the stripper blade facing the circulating surface, and the counter-bending prevention member configured to prevent bending of the one end portion of the stripper blade on the downstream side in the circulation direction of the circulating surface.

7. The image forming apparatus according to claim 6, wherein the circulation mechanism comprises:

the transport belt;

a cleaning roller that rotates in the direction opposite to the circulation direction of the transport belt and comes into contact with the transport belt; and a scraper roller to which electric charge having polarity opposite to that of the toner is applied, the scraper roller in contact with the surface of the cleaning roller, and the surface of the scraper roller being the circulating surface.

* * * * *